US006237261B1

(12) United States Patent
Hickle et al.

(10) Patent No.: US 6,237,261 B1
(45) Date of Patent: May 29, 2001

(54) AIR CONTROL VALVE SYSTEM FOR A GARMENT PRESS

(76) Inventors: Ernest J. Hickle, 2014 Rutledge Rd., New Market, TN (US) 37820; David G. Crockett, 5887 Timbercreek La., Morristown, TN (US) 37814

( * ) Notice: Subject to any disclaimer, the term of this patent is extended or adjusted under 35 U.S.C. 154(b) by 0 days.

(21) Appl. No.: 09/329,736

(22) Filed: Jun. 10, 1999

(51) Int. Cl.[7] ..... D06F 71/18; D06F 71/34

(52) U.S. Cl. ..... 38/7; 223/70

(58) Field of Search ..... 38/7, 14, 1 A, 38/1 C, 1 D; 223/67, 68, 70, 33, 74, 76; 251/324, 190, 117

(56) References Cited

U.S. PATENT DOCUMENTS 2,606,272 * 8/1952 Platt ..... 38/14
3,006,516 * 10/1961 Richterkessing ..... 223/70
3,433,396 * 3/1969 Swartz ..... 223/73
3,477,621 * 11/1969 Forse ..... 223/70
4,057,179 * 11/1977 Everett ..... 223/73
5,474,216 * 12/1995 Harrod et al. ..... 223/68 X
5,732,859 * 3/1998 Leblanc ..... 223/67

* cited by examiner

*Primary Examiner*—Ismael Izaguirre
(74) *Attorney, Agent, or Firm*—Pitts & Brittian, PC

(57) ABSTRACT

An air control valve system for a shirt body press wherein the shirt body press includes at least one mannequin which is positionable between two press plates. The mannequin defines at least two inflatable side air bags. The shirt body press further includes a blower system including a blower and a heat exchanger through which the blower exhausts. The air control valve system controls the flow of air out of the heat exchanger into inflatable air bags located at the sides and shoulders in two stages, a soft, or initial, air stage and a full pressure stage. The air control valve system includes at least one valve assembly for inflating the air bags. A flow controller can be mechanically adjusted to control the restricted flow rate of the soft air stage. A metering valve controls the rate at which the air flow rate is increased to the full pressure stage. The full pressure stage is timed to commence coincidentally with the closing of the press plates.

20 Claims, 4 Drawing Sheets

AIR CONTROL VALVE SYSTEM FOR A GARMENT PRESS

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

This invention relates to the field of shirt body presses and particularly to the control of air flow into the air bags of a conventional shirt body press.

2. Description of the Related Art

Shirt body presses have been used in the dry cleaning and laundering field to quickly and effectively press the shirt body of laundered shirts. A conventional shirt body press includes at least one mannequin or buck upon which the shirt body is supported and forward and rear pressing plates for pressing the shirt body therebetween.

Some shirt body presses are equipped with a mannequin which includes inflatable air bags at each side and proximate each shoulder. These air bags are inflated with air to stretch the shirt body at its sides and shoulders and to hold the shirt body in place while the press plates close thereby avoiding the creation of wrinkles in the shirt body during the pressing operation. This inflation occurs in two stages: a soft, or initial, air stage during the initial closing of the press plates to ensure the shirt body remains stationary followed by a full air stage to assist in the pressing operation.

The air bags are typically porous and therefore must be continuously subjected to forced air during desired inflation periods. Unfortunately, these air bags tend to deteriorate over time requiring greater pressure to maintain inflation. Accordingly, the air flow rate of the soft air stage can be adjusted to compensate for the deterioration of the air bags in order to introduce air into the air bag faster than it is lost. While adjustment is not frequently required, it is desirable to control the rate of the soft air to properly inflate the air bags for the best finish of shirts. In conventional presses, this adjustment is unnecessarily difficult as it requires taking the press off line.

Therefore, it is an object of the present invention to provide an air control valve system for a shirt body press for controlling the flow of air into the inflatable air bags of a mannequin.

It is another object of the present invention to provide an air control valve system for a shirt body press which inflates the air bags in two stages.

Yet another object of the present invention is to provide an air control valve system allowing the inflation of the side air bags and the shoulder air bags to be controlled individually.

Further, it is an object of the present invention to provide an air control valve system for a shirt body press which controls the rate at which air flow increases from the soft air stage to the full air stage in relation to the press heads closing on the mannequin or buck.

Still further, it is an object of the present invention to provide a mechanism for easily adjusting the volume of initial inflation air.

BRIEF SUMMARY OF THE INVENTION

Other objects and advantages will be accomplished by the present invention which provides an air control valve system for a shirt body press wherein the shirt body press includes at least one mannequin which is positionable between two press plates and the mannequin defines at least two inflatable side air bags. The shirt body press further includes a blower system including a blower and a heat exchanger through which the blower exhausts. The air control valve system controls the flow of air out of the heat exchanger into the inflatable side air bags and permits the flow of air into the air bags in one of two stages: a soft, or initial, air stage and a high pressure stage. The air control valve system is comprised of a valve, a cylinder, an initial air valve assembly and a metering valve. The valve defines a valve input in communication with the heat exchanger and a valve output in communication with the two inflatable side air bags. The initial air valve assembly controls the flow of air through the valve during the soft air stage. The metering valve controls the rate of increase in the air flow rate from the soft air stage to the full air stage by gradually opening the valve.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

An air control valve system for a shirt body press incorporating various features of the present invention is illustrated generally at 10 in the figures. The air control valve system for a shirt body press 10 is designed to control the flow of air into the air bags of a mannequin of a shirt body press. Further, in the preferred embodiment, the air control valve system inflates the air bags in two stages and includes a means for altering the timing of the full inflation of the air bags. The present invention further provides a mechanism for controlling the volume, and consequentially the pressure, of the initial air.

Figure 1:
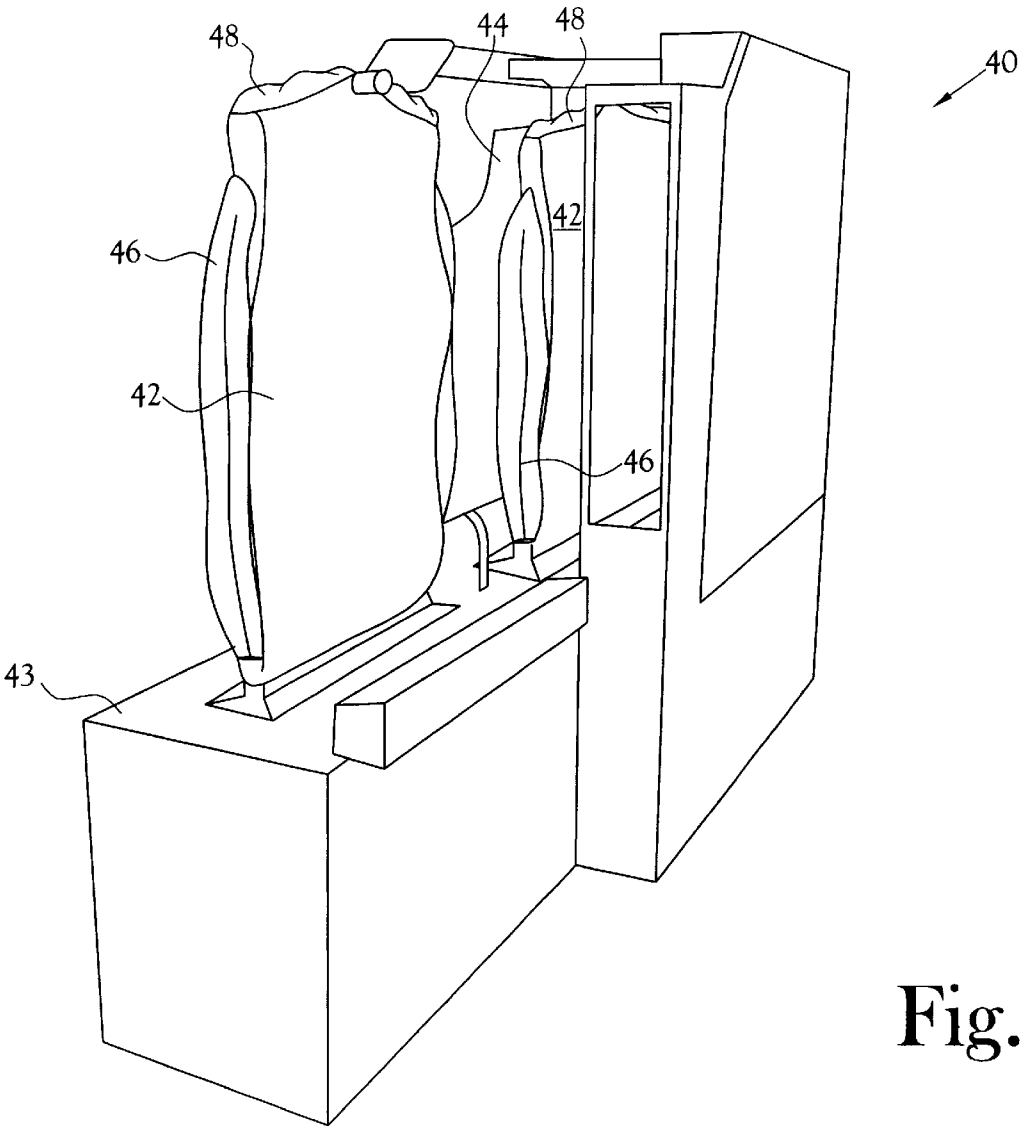
FIG. 1 is a front perspective view of a conventional shirt body press.

A conventional shirt body press 40 is illustrated in FIG. 1 and generally includes at least one mannequin 42, or buck, which is positioned on a support frame 43 and is movable to a position between a rear press plate 44 and front press plate (not shown). Each mannequin 42 includes inflatable side air bags 46 at each side and inflatable shoulder air bags 48 extending across the top of the buck from shoulder to shoulder. The side air bags 46 and shoulder air bags 48 are inflatable via a blower system 50. Further, the side and shoulder air bags 46, 48 are fabricated from a porous material.

Figure 2:
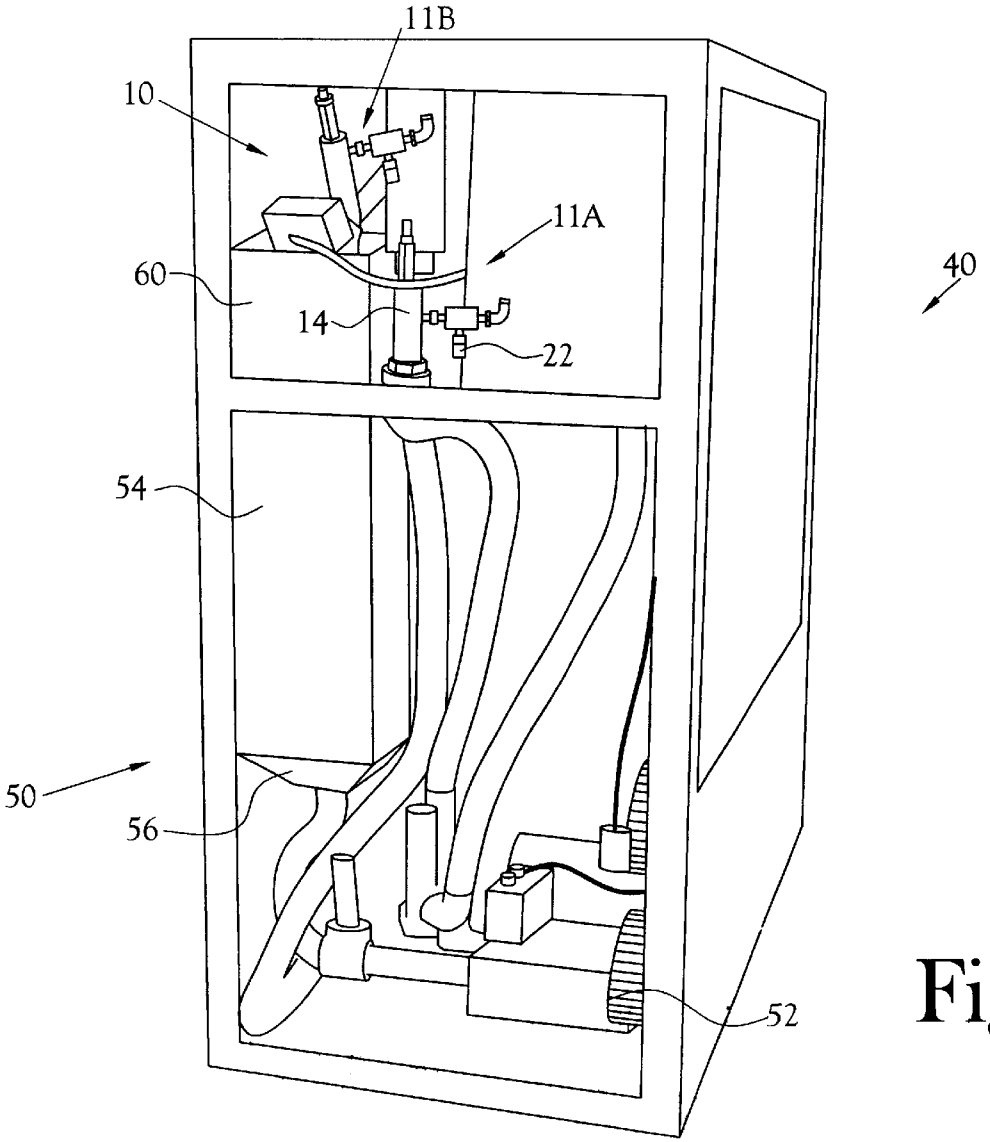
FIG. 2 is a rear perspective view of a conventional shirt body press showing the air control valve system.

The blower system 50 utilized in the present invention is illustrated in FIG. 2, and generally includes a blower 52, a heat exchanger 54 and the air control valve system 10 of the present invention. Specifically, the air control valve system 10 includes a first valve assembly 11A controlling the inflation of the side air bags 46 and a second valve assembly 11B for controlling the inflation of the shoulder air bags 48.

The inclusion of separate valve assemblies 11 for the side and shoulder air bags 46, 48, allows the flow rates to each of the side and shoulder air bags 46, 48 to be controlled individually. One skilled in the art will recognize that individual control provides for better pressing by allowing compensation for the specific deterioration of each air bag 46, 48, as well as more control in the volume of air which is required or desired. During inflation of the side and shoulder air bags 46, 48, the blower 52 exhausts through the heat exchanger 54, and the air control valve system 10 controls the flow of air out of the heat exchanger 54 into the side and shoulder air bags 46, 48.

Figure 3:
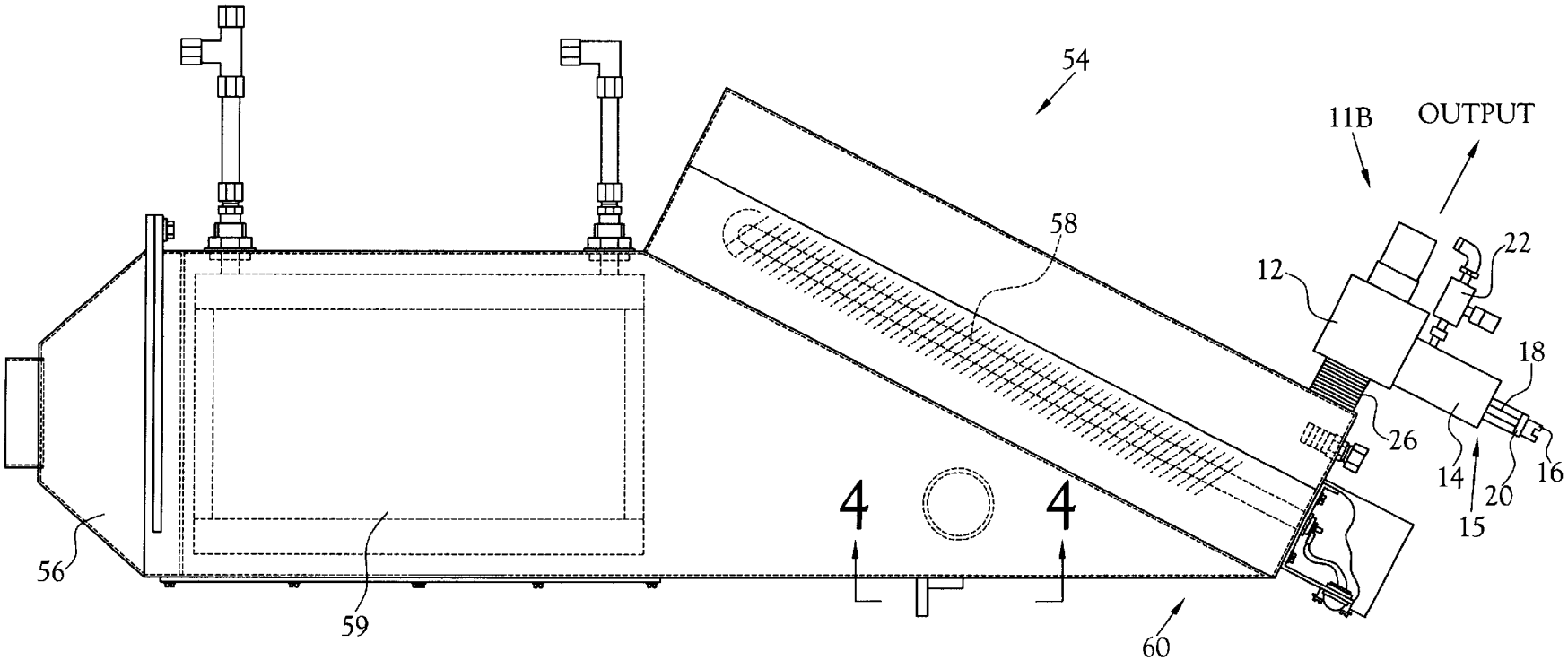
FIG. 3 is side view of the heat exchanger including the air control valve system of the present invention.

Referring now to FIG. 3, the heat exchanger 54 and the air control valve system 10 are shown in greater detail. The heat exchanger 54 defines a lower end 56 into which the blower 52 exhausts. The heat exchanger 54 includes a steam heat coil 59 around which the air from the blower 52 circulates. Air directed to the shoulder air bag 48 also is further heated by an electric heat coil 58. Each air control valve system 11 is mounted proximate the upper end 60 of the heat exchanger 54.

Figure 4:
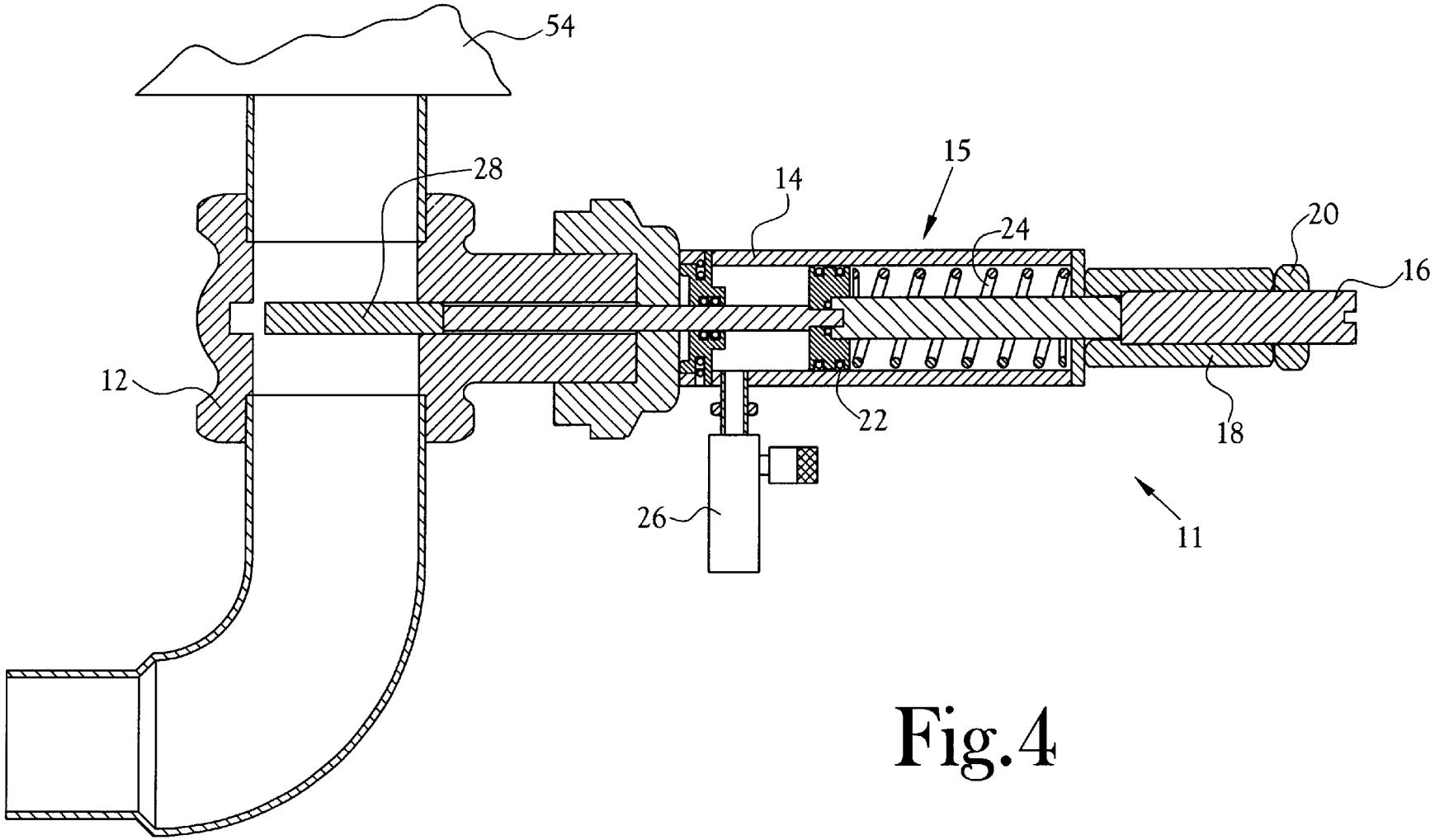
FIG. 4 is a view of air control valve system of the present invention taken along line 4—4 of FIG. 3.

FIG. 4 illustrates the valve assemblies 10 in detail. As the valve assemblies 11A, 11B are identical in construction, but differing in size, one assembly 11 is discussed in general hereinafter. The air valve assembly 11 includes a valve 12, a flow controller 15, and a metering valve 26. The flow controller 15 includes an adjustment nut 18 cooperating with a threaded stud 16 and held in place by lock nut 20 attached to a cylinder 14. The flow controller 15 operates to adjust the flow of air through valve 12 by opening and closing valve door 28. Using the adjustment nut 18 in cooperation with the threaded stud 16, the base flow rate through valve 12 can be easily set thereby allowing air to be slowly introduced into the side and shoulder air bags 46, 48 during the initial closing of the front and rear press plates 44 with sufficient pressure to inflate the air bags 46, 48.

The metering valve 26 is a timing device allowing the flow rate through valve 12 to be increased at a precise and controllable time within the pressing cycle so as to rapidly inflate the side and shoulder air bags 46, 48. This is accomplished by forcing air into a cylinder 14, which houses a piston 22 biased by a spring 24 and connected to the threaded stud 16, thereby moving piston 22 and further opening valve door 28. When the forced air from the metering valve 26 stops, the spring 24 operates to return the piston 22 to the base position set by the adjustment nut 18 and the threaded stud 16.

The air control valve system 10 of the present invention serves to control the flow of air into the side and shoulder inflatable air bags 46, 48 during the pressing operation of a shirt body. The air bags 46, 48 inflate to stretch the sides and shoulders of the shirt being pressed so as to avoid the introduction of wrinkles resulting from the closing of the press plates 44. During the pressing operation, the air control valve system 10 delivers air to the air bags 46, 48 in two stages. The first stage is an initial, or soft air stage, where the flow of air into the inflatable air bags 46, 48 is restricted and the second stage is a full pressure air stage where air is delivered to the inflatable air bags 46, 48 at a pressure sufficient to effectuate pressing of the shirt body. It will be noted that because the air flowing into the side and shoulder bags 46, 48 is heated and the air bags are porous, the shoulders and sides of the shirt body are pressed or smoothed at these locations.

The initial or soft air stage serves to inflate the air bags 46, 48 to slightly blow the shirt sides and shoulders out. As previously noted the air flowing into the inflatable air bags 46, 48 during the soft air stage is controlled via the flow controller 15. Specifically, air exiting the heat exchanger 54 passes through the valve 12 at a rate determined by the flow controller 15. This rate is selected to slowly introduce air into the inflatable air bags 46, 48. By tightening or loosening the adjustment nut 18, the air flow can be increased or decreased as required to inflate the air bags 46, 48 at the desired rate. It will be noted that the flow controller 15 defines the lower flow limit of the initial air such that the air flow through the valve 12 is always considered soft air.

As the press plates 44 close to a predetermined position around the mannequin 42, the metering valve 26 introduces forced air into the cylinder 14 operating the piston 22 and increasing the air flow through the valve 12 to the full pressure needed during the pressing cycle. The timing of the beginning of the full pressure stage in relation to the closing of the press plates 44 against the mannequin 42 upon which a shirt is dressed, is critical to the finishing of the shirt body. If the full pressure stage is entered too soon, the shirt body can move thereby causing wrinkles or distortion of the shirt body. If the full pressure stage is entered too late, the sides and shoulders of the shirt body will not be sufficiently stretched out to remove wrinkles at these locations. It is preferable that the inflatable air bags 46, 48 are inflated at the time that the press plates 44 engage the shirt body.

From the foregoing description, it will be recognized by those skilled in the art that an air control valve system for a shirt body press offering advantages over the prior art has been provided. Specifically, the air control valve system for a shirt body press provides for two stage inflation of the air bags of a mannequin. Additionally, the present invention provides an easy mechanism for adjustment of the air flow used to inflate the air bags of a mannequin. Further, the air control valve system of the present invention provides a means for controlling the inflation of the side and shoulder air bags individually at both the soft air and the full air stages. Finally, the present invention provides a mechanism for controlling the timing of the introduction of full pressure air to the air bags in relation to the closing of the press plates.

While a preferred embodiment has been shown and described, it will be understood that it is not intended to limit the disclosure, but rather it is intended to cover all modifications and alternate methods falling within the spirit and the scope of the invention as defined in the appended claims.

What is claimed is:

1. An air valve assembly for controlling the air flow in a garment press, said air valve assembly comprising:

a main valve for regulating a flow rate of air used to inflate an air bag on a garment press, said main valve including a valve door;

a flow controller connected to said valve door for determining a soft air flow rate, said soft air flow rate being the selected minimum flow rate of air through said main valve; and a metering valve connected to said flow controller for increasing said soft air flow rate to a full air flow rate at a predetermined time.

2. The air valve assembly of claim 1 wherein said metering valve is connected to said flow controller at a location between said piston and a distal end of said cylinder whereby forced air is introduced into said cylinder thereby displacing said piston such that said valve door opens to increase the flow rate of air through said main valve, said forced air having a pressure greater than that of said spring.

3. The air valve assembly of claim 1 wherein said main valve is disposed in line between a heat exchanger and the air bag.

4. An air valve assembly for a garment press wherein the garment press includes at least one mannequin which is positionable between two press plates, the mannequin defining at least two inflatable side air bags, the garment press further including a blower system including a blower and a heat exchanger through which the blower exhausts, said air control valve system for controlling flow of air out of the heat exchanger into the inflatable side air bags, said air valve assembly comprising:

a main valve defining an input and an output, said main valve input in communication with the heat exchanger and with the two inflatable side air bags, said main valve including a valve door;

a flow controller connected to said valve door, said flow controller for restricting the flow of air through said main valve; and a metering valve connected to said flow controller, said metering valve for overriding said flow controller to change the flow of air though said main valve.

5. The air valve assembly of claim 4 wherein said flow controller defines a lower air flow limit.

6. The air valve assembly of claim 5 wherein said metering valve operates to increase the flow of air through said main valve at a predetermined time selected to correspond with the press plates closing against said mannequin.

7. A system for controlling the timing and inflation of air bags in a garment press, said system comprising:

a mannequin having at least one inflatable air bag;

a blower in communication with said at least one inflatable air bag;

a heat exchanger coupled between said blower and said at least one inflatable air bag; and at least one air valve assembly coupled between said heat exchanger and said at least one inflatable air bag, said at least one air valve assembly including a main valve for regulating a flow rate of air used to inflate an air bag on a garment press, a flow controller connected to said valve door for determining a soft air flow rate, and a metering valve connected to said flow controller for increasing said soft air flow rate to a full air flow rate at a predetermined time, said main valve including a valve door, said soft air flow rate being the selected minimum flow rate of air through said main valve.

8. The system of claim 7 wherein said at least one air bag includes a side air bag and a shoulder air bag, said at least one air valve assembly including a first air valve assembly connected to said side air bag and a second air valve assembly connected to said shoulder air bag, each of said first air valve assembly and said second air valve assembly being independent of each other.

9. The system of claim 7 wherein said metering valve is connected to said flow controller at a location between said piston and a distal end of said cylinder whereby forced air is introduced into said cylinder thereby displacing said piston such that said valve door opens to increase the flow rate of air through said main valve, said forced air having a pressure greater than that of said spring.

10. An air valve assembly for controlling the air flow in a garment press having an inflatable air bag and an air supply, said air valve assembly comprising:

a main valve in fluid communication between the air supply and the inflatable air bag, said main valve including a valve door;

a metering valve in fluid communication with the air supply, said metering valve outputting a metered air flow at a predetermined time within a pressing cycle; and a flow controller connected to said valve door and in fluid communication with said metering valve, said flow controller opening and closing said valve door to vary an air flow rate through said main valve in response to said metered air flow.

11. The air valve assembly of claim 10 wherein said flow controller holds said valve door in a partially open state to provide a continuous minimum air flow defined as soft air.

12. The air valve assembly of claim 10 wherein said flow controller fully opens said valve door in response to a burst of air from said metering valve.

13. An air valve assembly for controlling the air flow in a garment press, said air valve assembly comprising:

a main valve for regulating a flow rate of air used to inflate an air bag on a garment press, said main valve including a valve door;

a flow controller connected to said valve door for determining a soft air flow rate, said soft air flow rate being the selected minimum flow rate of air through said main valve, said flow controller includes a cylinder housing a piston biased by a spring, a threaded stud connected to said piston, an adjustment nut cooperating with said threaded stud for setting a resting position for said piston within said cylinder, and a locking nut for retaining said adjustment nut on said threaded stud, said piston being connected to said valve door; and a metering valve connected to said flow controller for increasing said soft air flow rate to a full air flow rate at a predetermined time.

14. The air valve assembly of claim 13 wherein said metering valve is connected to said flow controller at a location between said piston and a distal end of said cylinder whereby forced air is introduced into said cylinder thereby displacing said piston such that said valve door opens to increase the flow rate of air through said main valve, said forced air having a pressure greater than that of said spring.

15. The air valve assembly of claim 13 wherein said main valve is disposed in line between a heat exchanger and the air bag.

16. An air valve assembly for a garment press wherein the garment press includes at least one mannequin which is positionable between two press plates, the mannequin defining at least two inflatable side air bags, the garment press further including a blower system including a blower and a heat exchanger through which the blower exhausts, said air control valve system for controlling flow of air out of the heat exchanger into the inflatable side air bags, said air valve assembly comprising:

a main valve defining an input and an output, said main valve input in communication with the heat exchanger, said main valve output in communication with the two inflatable side air bags;

a flow controller for restricting the flow of air through said main valve wherein said flow controller defines a lower air flow limit, said flow controller including a cylinder housing a piston biased by a spring, a threaded stud connected to said piston, an adjustment nut cooperating with said threaded stud for setting a resting position for said piston within said cylinder, and a locking nut for retaining said adjustment nut on said threaded stud, said piston being connected to said main valve; and a metering valve for overriding said flow controller to change the flow of air though said main valve.

17. The air valve assembly of claim 16 wherein said metering valve operates to increase the flow of air through said main valve at a predetermined time selected to correspond with the press plates closing against said mannequin.

18. A system for controlling the timing and inflation of air bags in a garment press, said system comprising:

a mannequin having at least one inflatable air bag;

a blower in communication with said at least one inflatable air bag;

a heat exchanger coupled between said blower and said at least one inflatable air bag; and at least one air valve assembly coupled between said heat exchanger and said at least one inflatable air bag, said at least one air valve assembly including a main valve for regulating a flow rate of air used to inflate an air bag on a garment press, a flow controller connected to said valve door for determining a soft air flow rate, and a metering valve connected to said flow controller for increasing said soft air flow rate to a full air flow rate at a predetermined time, said main valve including a valve door, said soft air flow rate being the selected minimum flow rate of air through said main valve, said flow controller including a cylinder housing a piston biased by a spring, a threaded stud connected to said piston, an adjustment nut cooperating with said threaded stud for setting a resting position for said piston within said cylinder, and a locking nut for retaining said adjustment nut on said threaded stud, said piston being connected to said valve door.

19. The system of claim 18 wherein said at least one air bag includes a side air bag and a shoulder air bag, said at least one air valve assembly including a first air valve assembly connected to said side air bag and a second air valve assembly connected to said shoulder air bag, each of said first air valve assembly and said second air valve assembly being independent of each other.

20. The system of claim 18 wherein said metering valve is connected to said flow controller at a location between said piston and a distal end of said cylinder whereby forced air is introduced into said cylinder thereby displacing said piston such that said valve door opens to increase the flow rate of air through said main valve, said forced air having a pressure greater than that of said spring.

* * * * *